US007237468B2

(12) United States Patent
Laine

(10) Patent No.: US 7,237,468 B2
(45) Date of Patent: Jul. 3, 2007

(54) PROJECTILE FIRING DEVICE

(75) Inventor: Loic Laine, Saint Doulchard (FR)

(73) Assignee: Giat Industries, Versailles (FR)

( * ) Notice: Subject to any disclaimer, the term of this patent is extended or adjusted under 35 U.S.C. 154(b) by 0 days.

(21) Appl. No.: 11/178,354

(22) Filed: Jul. 12, 2005

(65) Prior Publication Data

US 2006/0288857 A1 Dec. 28, 2006

(30) Foreign Application Priority Data

Jul. 16, 2004 (FR) ..... 04 07963

(51) Int. Cl.
*F41F 1/06* (2006.01)

(52) U.S. Cl. ..... 89/37.05; 89/37.13

(58) Field of Classification Search ..... 89/37.05, 89/40.02, 37.12; 42/1.01–1.05
See application file for complete search history.

(56) References Cited

U.S. PATENT DOCUMENTS

| | | | | |
|---|---|---|---|---|
| 2,978,961 | A * | 4/1961 | Warren | 89/37.01 |
| 3,256,608 | A * | 6/1966 | Neisius | 33/228 |
| 3,500,714 | A * | 3/1970 | Cullinane | 89/1.1 |
| 4,280,394 | A | 7/1981 | Singenberger et al. | |
| 4,461,201 | A * | 7/1984 | Van Sloun | 89/1.57 |
| 4,466,332 | A * | 8/1984 | Van Sloun | 89/1.51 |
| 4,469,005 | A * | 9/1984 | Schaulin et al. | 89/33.14 |
| 4,662,265 | A * | 5/1987 | Becker et al. | 89/37.09 |
| 5,452,640 | A * | 9/1995 | Bovee et al. | 89/1.815 |
| 5,661,254 | A | 8/1997 | Steuer et al. | |
| 6,189,430 | B1 | 2/2001 | Vornfett | |
| 6,802,147 | B2 * | 10/2004 | Haefeli et al. | 42/1.05 |
| 2003/0051597 | A1 * | 3/2003 | O'Dwyer | 89/1.11 |
| 2005/0241468 | A1 * | 11/2005 | Borgwarth et al. | 89/40.02 |

FOREIGN PATENT DOCUMENTS

| | | |
|---|---|---|
| EP | 0 932 014 A2 | 7/1999 |
| WO | WO 01/01060 A1 | 1/2001 |

* cited by examiner

*Primary Examiner*—Troy Chambers
*Assistant Examiner*—Stewart Knox
(74) *Attorney, Agent, or Firm*—Oliff & Berridge, PLC

(57) ABSTRACT

The invention relates to a projectile firing device used on a platform and comprising at least two tubes integral with a base.

This device is characterized in that the base is mounted able to swivel on a turret around a first, substantially horizontal axis, such swiveling controlled by first drive means, the turret being able itself to pivot with respect to the platform around a second substantially vertical axis and being controlled by second drive means, the horizontal swiveling being made on either side of a median position in which the tubes are oriented with their axes substantially vertical.

8 Claims, 4 Drawing Sheets

PROJECTILE FIRING DEVICE

BACKGROUND OF THE INVENTION

1. Field of Invention

The technical scope of the invention is that of devices enabling projectiles to be fired from a platform.

2. Description of Related Art

Known devices comprise one or several tubes integral with a base, each tube being intended to receive at least one projectile as well as a propellant charge enabling said projectile to be expelled.

It is thus known for turrets to be made for cannons, which are mobile in traverse (that is to say around a vertical axis) and in elevation (with respect to a horizontal axis). Cannon turrets are more often than not implemented on armored vehicles and are generally able to swivel in traverse around 360°.

The elevation swiveling capacity is, however, more like 50° at most for a medium-calibre anti-aircraft cannon turret.

It is known to implement multi-tube devices to ensure the scattering of mines. These devices comprise at least two rows of multi-tube bases, able to move only in elevation, and positioned on either side of a platform integral with a specific vehicle.

The maximum swiveling capacity in elevation of these platforms is of 45° at most.

The vehicles thus implemented have been designed to rapidly lay large-sized mine fields. They are over-sized with respect to present-day needs, namely in terms of urban combat. Moreover, they are not suited to the rapid installation of small clusters of anti-tank mines, namely used to obstruct a passing place.

Moreover, for future military engineering vehicles it will be necessary to have launchers able to fire different types of projectiles, lethal or not, as may be selected or required.

SUMMARY OF THE INVENTION

The aim of the invention is to propose a firing device that will overcome such drawbacks.

Thus the firing device according to the invention enables the quick and accurate installation of the projectiles, at a relatively short distance from the carrier vehicle, but in any direction around the vehicle.

The device according to the invention also enables the selection of the type of projectile to be scattered without the necessity of complicated maneuvers.

Thus, the invention relates to a projectile firing device used on a platform and comprising at least two tubes integral with a base, each tube enclosing at least one projectile as well as a propellant charge enabling the projectile to be expelled from the tube, such device wherein the base is mounted able to swivel on a turret around a first, substantially horizontal axis, such swiveling controlled by drive means, the turret being able itself to pivot with respect to the platform around a second substantially vertical axis and being controlled by second drive means, the horizontal swiveling is made on either side of a median position in which the tubes are oriented with their axes substantially vertical.

The first and second drive means are preferably connected to a control box ensuring the positioning of the base in elevation and in traverse with respect to the platform.

Advantageously, swiveling in elevation will be between +90° and −90° with respect to the median position and positioning in traverse will be between +90° and −90° with respect to a starting position.

At least two of the device's tubes may enclose projectiles of different types, means being provided to determine the type of the projectiles installed in each tube.

The device may comprise means to transmit a programming signal to at least one projectile enclosed in a tube.

The propellant charges for the projectiles may be defined so as to impart them with a maximal range of between 80 and 100 m.

Advantageously, each launcher tube may constitute a full round integrating at least one projectile and one propellant charge.

Means enabling the type of projectile to be determined may comprise scanning means carried on the base and cooperating with a component that is integral with the tube.

The device may incorporate at least one tube enclosing scatterable mines.

BRIEF DESCRIPTION OF THE DRAWINGS

The invention will become more apparent from the following description of a particular embodiment, such description being made with reference to the appended drawings, in which.

DETAILED DESCRIPTION OF PREFERRED EMBODIMENTS

Figure 1:
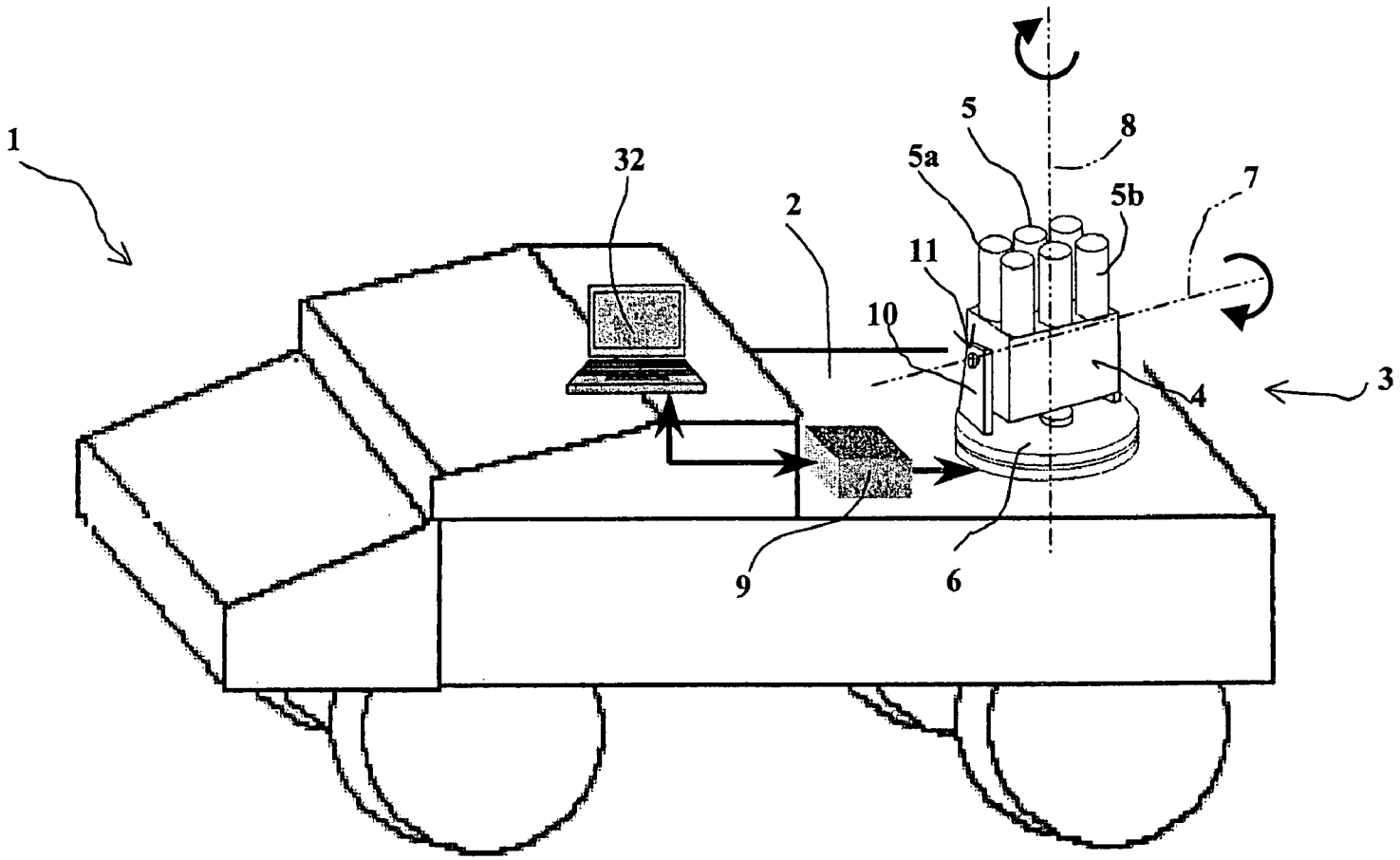
FIG. 1 is a schematic perspective view of a vehicle fitted with a firing device according to the invention.

With reference to FIG. 1, a wheeled armored vehicle 1 incorporates a rear bed 2 onto which is installed a firing device 3 according to the invention.

This device comprises a base 4 carrying projectile launcher tubes 5 (not shown in this figure), here there are two rows of three tubes 5. Each tube encloses at least one projectile as well as a propellant charge enabling the projectile to be expelled from the tube.

The projectile may be constituted by a stack of anti-tank mines or by non-lethal ammunition. The tube 5 may advantageously be fastened to the base by a quick assembly method, for example using a bayonet. Such a consumable tube will thus constitute a piece of ammunition that can be replaced after firing. One example of a launcher tube 5 will be described hereafter.

The base 4 is mounted able to swivel on a turret 6 around a first, substantially horizontal, axis 7.

The turret 6 itself is able to pivot with respect to the platform 2 around a second axis 8 that is substantially vertical.

The pivoting is controlled by drive means connected to a control box 9 integral with the vehicle 1.

The latter is piloted by a Man/Machine interface 32 associating a screen and keyboard.

Figure 2:
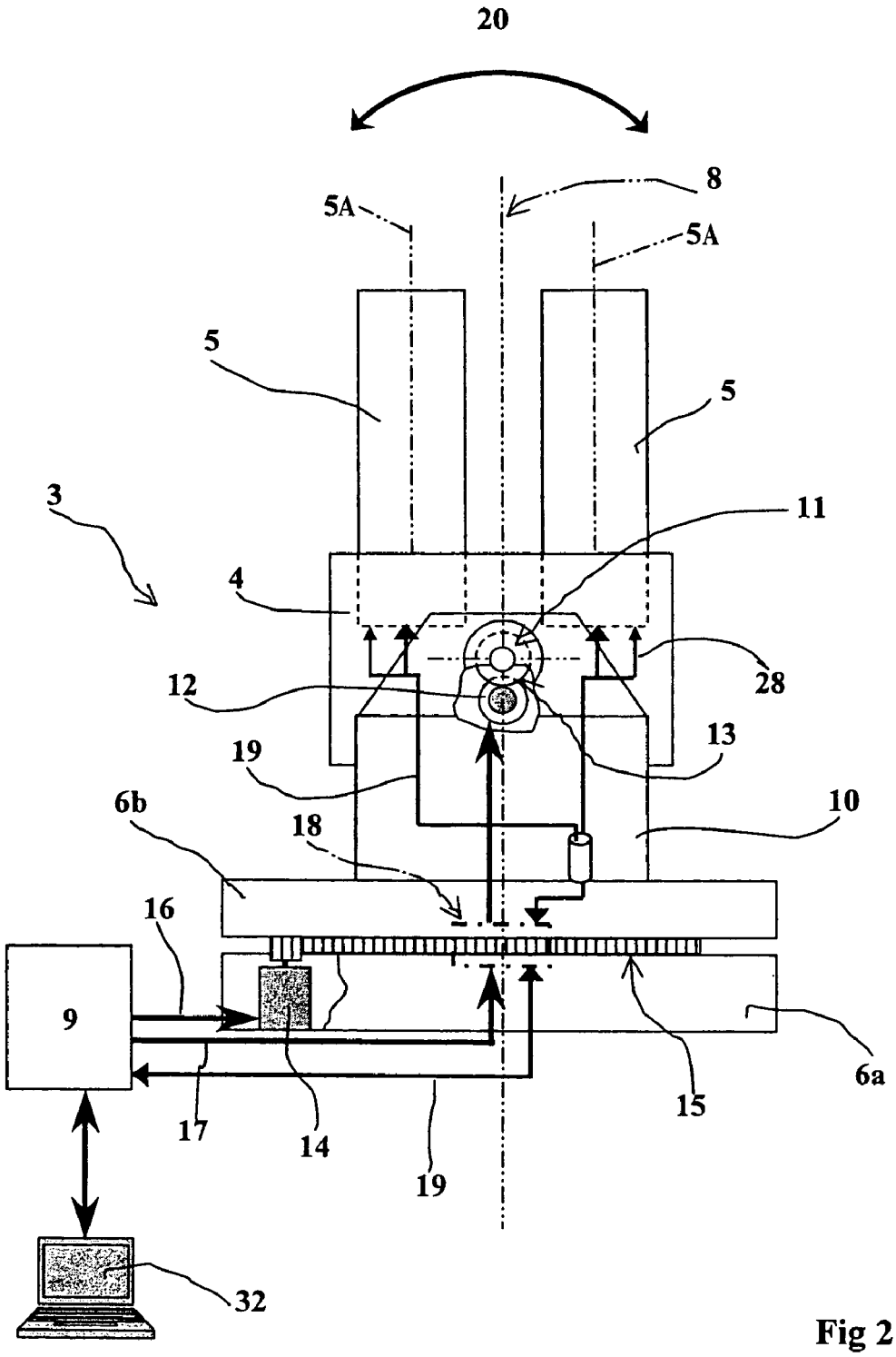
FIG. 2 is a side view with partial cut outs of the device associated with its control means.

As may be seen more particularly in FIG. 2, the turret 6 comprises a fixed part 6*a*, fastened to the platform 2 by suitable means, such as screws (not shown).

The turret 6 also comprises a mobile part 6*b* mounted able to pivot with respect to the fixed part 6*a*, for example using one or several bearings (not shown).

The mobile part 6*b* has a cradle 10 formed of two vertical arms each carrying a trunnions 11 enabling the base 4 to swivel with respect to the first axis 7 (or horizontal axis). This swiveling is controlled by first drive means 12 which comprise, for example, an electric motor integral with one of the cradle arms 10 and which drives a pinion 13 integral with the base 4.

The device also incorporates second drive means 14, which comprise, for example, an electric motor integral with the fixed part 6*a* of the turret and which drive a toothed crown gear 15 integral with the mobile part 6*b* of the turret.

The second drive means 14 make the turret 6 pivot with respect to the second axis 8 (or vertical axis).

The electrical connections between the control box 9 and the drive means are schematized by marks 16 and 17.

So as to make the turret easier to pivot around the vertical axis 8, the electrical connection 17 between the control box 9 and the first drive means 12 is advantageously made by means of a revolving connector 18 centered on the vertical axis 8.

It would naturally be possible to replace the revolving connector by lengths of wire that are enough to permit the required pivoting.

The electrical connection between the control box 9 and the tubes 5 is marked 19. This connection enables a firing command to be transmitted to one or other of tubes 5 so as to fire one or several projectiles.

Electrical connection 19 also passes via the revolving connector 18.

A programming signal may also be passed to one or other of the tubes that is intended for the projectile, for example the programming of the activity time for scatterable mines. This transmission will be carried out by a specific electrical connection (not shown).

So as to simplify the wiring, all six tubes 5 may naturally be controlled by a single two-wired BUS line implementing a communication protocol enabling the electronic box 9 to select one of the igniters carried by each of the launcher tubes 5.

Patent FR2801698 describes an example of a communication protocol, which can be thus implemented.

FIG. 2 shows the device in the starting condition in a median position in which the tubes 5 are oriented with their axes 5A substantially vertical (thus parallel to the axis of rotation 8).

In this position the rotational inertia of the turret 6 carrying the tube is minimal. Pivoting around the axis 8 may thus be carried out rapidly using minimal energy.

Horizontal swiveling (schematized by arrow 20) is made around the horizontal axis 7 on either side of this median position.

Figure 3A:
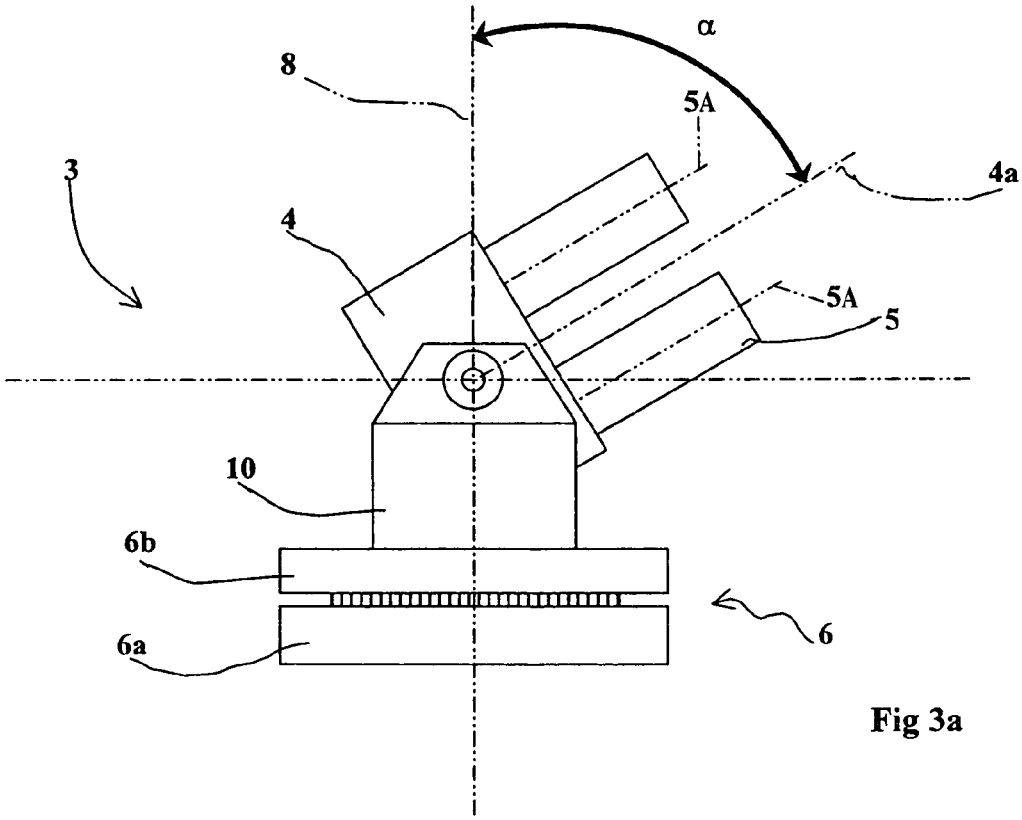
FIGS. 3*a* and 3*b* are two side views of the device in different elevation orientation positions.
Figure 3B:
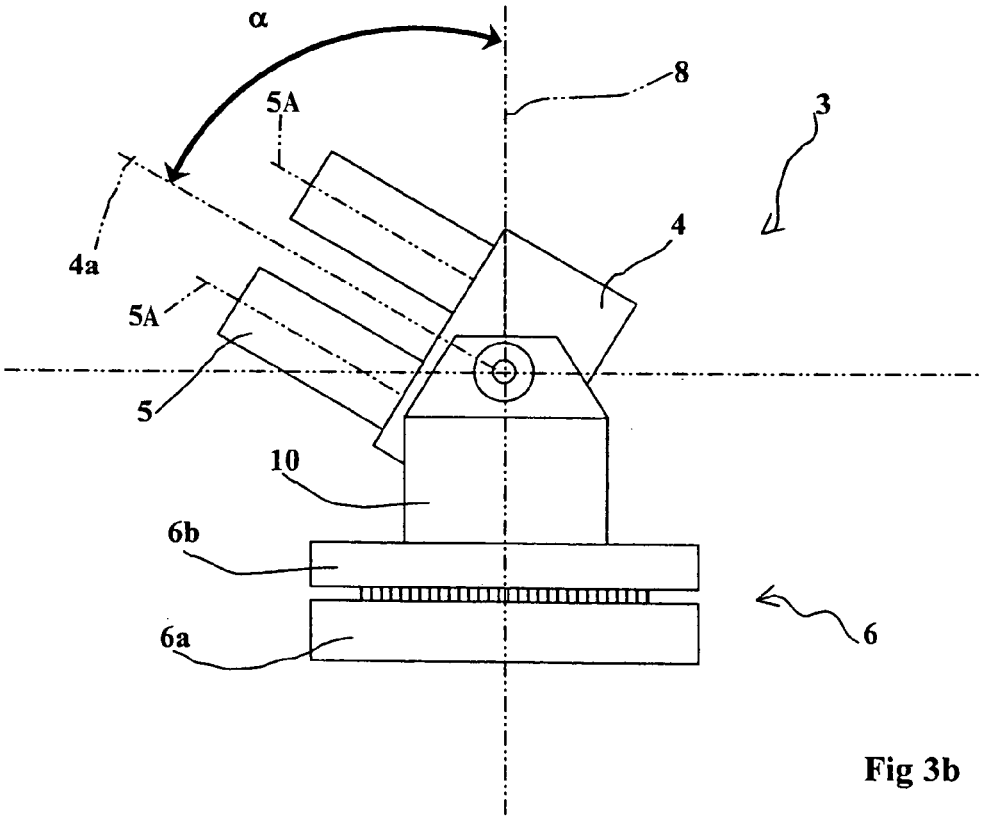

FIGS. 3*a* and 3*b* thus show, by way of example, two positions for the device, symmetrical to one another, and in which the angle of inclination □ in elevation of the axis 4*a* of the base 4 carrying the tubes 5 is of + or −45° with respect to the vertical axis 8.

We see that the device according to the invention enables the quick and accurate installation of projectiles in any direction around the carrier vehicle 1.

Indeed, the turret is practically able to pivot 360° around the vertical axis 8.

But in practical terms (because of the ability of the base 4 to swivel on either side of a median position in which the tubes 5 are vertical) it is enough to enable a pivoting of +/−90° around the vertical axis 8 and whatever the starting position of the base 4 to enable firing to be aimed at any zone around the vehicle. The laying of the firing device 3 in elevation and in traverse is thus very rapid.

The pivoting speed is, moreover, improved by the low rotational inertia of the device 3 when the tubes 5 are in their vertical position (FIG. 2).

The essential characteristic of the invention which enables the area covered by a single device to be increased is this capacity of the base 4 to swivel on either side of a position in which the tubes are vertical.

It goes without saying that, operationally, the tubes 5 may be left in any position in any orientation in elevation and that the swiveling around the vertical axis may be controlled (even if the inertia is greater) when the elevation angle is not nil (non vertical tubes).

According to another characteristic of the invention, at least two of the launcher tubes 5 may enclose projectiles of different types. Thus, a first tube 5*a* (FIG. 1) may enclose anti-tank mines and a second tube 5*b* may contain zone-protection non-lethal ammunition.

Tubes enclosing other types of ammunition may also be provided, for example, smoke-producing ammunition or flares.

Such an arrangement increases the device's operational capabilities. Indeed, it is no longer necessary to change the ammunition in the field to be able to adapt to new operational requirements.

It is thus necessary to provide means at each tube 5 allowing the type of projectile installed in said tube to be determined.

Figure 4:
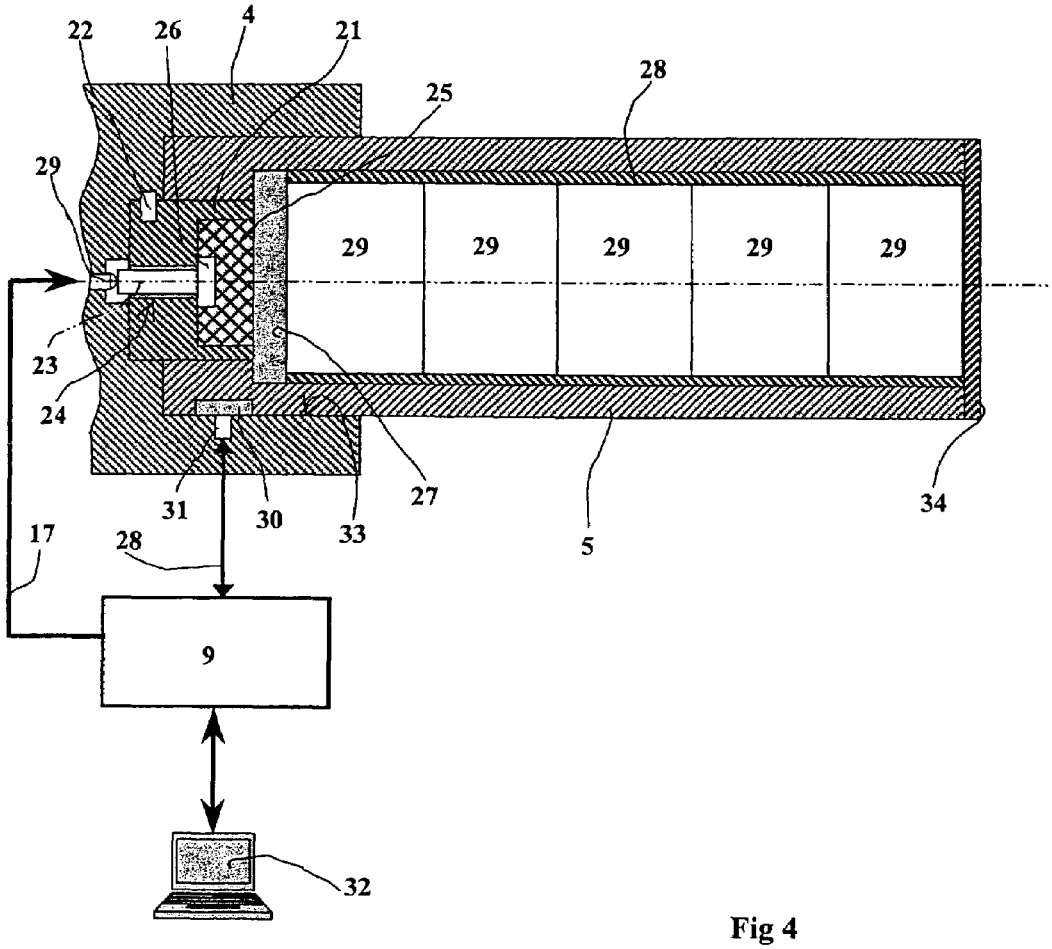
FIG. 4 is a longitudinal section view of one embodiment of a projectile launch tube.

FIG. 4 shows an example of an ammunition tube 5 according to the invention.

The tube 5 has a stud 21 screwed onto its rear part which has a radial snug 22 enabling it to be fastened to the tube 5 by a bayonet mounting on the base 4. The base 4 in this case has as many cylindrical housings 33 as tubes 5. The stud 21 has an axial contact 23 that is electrically insulated from the stud 21 by an insulating sheath 24.

The stud 21 encloses a propellant charge 25 and an igniter 25 which is electrically connected firstly to the contact 23 and secondly to the metallic body of the stud 21. The tube 5 encloses a piston 27 onto which a cylindrical casing 28 is applied which encloses a stack of five anti-tank mines 29. The tube is closed by a lid 34 connected to the tube by a shearable pin (not shown).

The propellant charge 25 will be defined such that it imparts a maximum range to the projectile of between 80 and 100 m. The possibility of scattering small clusters of mines is thereby ensured over a reduced distance enabling the temporary closure of an itinerary in an urban zone.

The contact 23 presses on an electrical contact 29 integral with the base 4 and connected to the control box 9 by connection 17.

According to the invention, the tube 5 has an active component 30 near to its bottom, such as a memory chip incorporating a code enabling the type of projectile installed in the tube 5 to be determined.

This component cooperates with scanning means 31 integral with the base 4 and connected to the control box 9 by a connection 28 and by means of the revolving connector 18 (see also FIG. 2).

The contact-free communication technologies between a memory chip and a remote scanner are well known to the Expert and are already implemented industrially, for example to monitor production or to monitor animal populations. It is thus unnecessary to describe such components in any greater detail.

Inductive scanning means 31 or scanning means with contacts may be used.

The component 30 may also be replaced by a bar code fastened to the tube 5 and scanned by an optical detector 31 housed in the base 4.

The control box 9 thus knows the exact nature of the projectile carried in each tube 5.

The user may thus choose not only in which zone surrounding the vehicle the projectile is to be fired but also which type of projectile is to be fired.

With regard to the Man/Machine interface 32, the user merely has to select the type of projectile required as well as the zone into which the projectile is to be projected.

A suitable algorithm, memorized in the control box computer will thus select the correct tube or tubes 5 according to the user's requirements and will give the orientations in elevation and in traverse required to launch the projectile or projectiles selected from the tube or tubes at the chosen target point. These orientations will take into account the position of the selected tube on the base 4.

The connection 28 may advantageously be used to transmit suitable programming (for example an activity time) to the projectiles 29. In this case, the scanning means 31 will be selected so as to be able to transmit a programming signal to the active component 30 which will, itself, be connected to the projectiles 29.

The invention has been described here in the form of a single firing device installed on a vehicle. It is naturally possible to arrange several firing devices on a single vehicle. It is also possible to place one or several firing devices according to the invention on a fixed, land or naval, platform.

What is claimed is:

1. A projectile firing device, comprising:

a turret mounted to a platform, the turret capable of swiveling +/−90° in traverse from a base position;

a cradle mounted to the turret and supporting a base, the base capable of swiveling in elevation;

at least two tubes mounted to the base, each of at least two tubes enclosing at least one projectile as well as a propellant charge enabling the at least one projectile to be expelled from the tube, at least one tube enclosing scatterable mines;

a first drive mechanism driving the swiveling of the base in elevation;

a second drive mechanism to traverse the turret around a substantially vertical axis, wherein the base is capable of swiveling +/−90° in elevation from a median position in which the tubes are substantially vertical.

2. The projectile firing device according to claim 1, wherein said first and second drive mechanisms are connected to a control box ensuring the positioning of said base in elevation and in traverse with respect to said platform.

3. The projectile firing device according to claim 1, wherein at least two of said device's tubes enclose projectiles of different types, means being provided to determine the type of said projectiles installed in each of said tubes.

4. The projectile firing device according to claim 3, wherein said device comprises means to transmit a programming signal to at least one of said projectile enclosed in one tube.

5. The projectile firing device according to claim 4, wherein the propellant charges for said projectiles may be defined so as to impart said projectiles with a maximal range of between 80 and 100 m.

6. The projectile firing device according to claim 5, wherein each said launcher tube constitutes a full round integrating at least one projectile and one propellant charge.

7. The projectile firing device according to claim 3, wherein said means enabling the type of said projectile to be determined may comprise scanning means carried on said base and cooperating with a component that is integral with said tube.

8. The projectile firing device according to claim 6, wherein means enabling the type of projectile to be determined may comprise scanning means carried on the base and cooperating with a component that is integral with the tube.

* * * * *